United States Patent [19]

Brown

[11] 4,224,016

[45] Sep. 23, 1980

[54] ROTARY POSITIVE DISPLACEMENT MACHINES

[76] Inventor: Arthur E. Brown, Box 78, R.D. 1, Lake George, N.Y. 12845

[21] Appl. No.: 946,320

[22] Filed: Sep. 27, 1978

[51] Int. Cl.[3] ..... F01C 1/08; F04C 18/08

[52] U.S. Cl. ..... 418/191

[58] Field of Search ..... 418/191, 199, 200

[56] References Cited

U.S. PATENT DOCUMENTS

| | | | |
|---|---|---|---|
| 67,978 | 8/1967 | Hanford | 418/191 |
| 92,842 | 7/1869 | Knapp | 418/191 |
| 3,472,445 | 10/1969 | Brown | 418/191 |

FOREIGN PATENT DOCUMENTS

| | | | |
|---|---|---|---|
| 992226 | 5/1965 | United Kingdom | 418/191 |

*Primary Examiner*—John J. Vrablik

*Attorney, Agent, or Firm*—Bernard J. Murphy

[57] ABSTRACT

The machines may function as a rotary compressor, vacuum pump, expansion engine, or the like. Two interengaging rotors rotate within intersecting bores in a casing structure. Two higher pressure ports are located one in each flat end wall of the casing. One rotor opens and closes the two higher pressure ports so as to control the flow of air or gas through same. The optimum number of teeth or lobes for each rotor is two. The port controlling first rotor has lobes of small included angle so as to reduce the effect of a precompression loss. The coacting second rotor has lobes of larger included angle so as to improve performance.

15 Claims, 7 Drawing Figures

ROTARY POSITIVE DISPLACEMENT MACHINES

This application is related to and is co-pending with my other application Ser. No. 946,591, filed Sept. 28, 1978.

DISCUSSION OF PRIOR ART

In some fluid handling machines, especially in gas compressors having rotors with interengaging teeth or lobes and recesses, the rotors, in cooperation with the walls of intersecting bores of the compressor casing, define a pair of separate, variable volume chambers which, cyclically merge into one. During each cycle, one of the chambers "pre-pressurizes" while the other chamber remains at inlet pressure. The pre-pressurized gas in the one chamber subsequently throttles into the other with a significant loss, thus constituting a marked inefficiency in such prior art machines.

U.S. Pat. No. 4,068,988 issued Jan. 17, 1978, to Paul Dale Webb, et al, for a "Positive-displacement, Fluid Machine," disclosed a novel means for equalizing chamber pressures, or for reducing pre-pressurization of a chamber, through the employment of an inter-chamber conduit. The present invention sets forth an alternative, novel means for effecting early equalization of such chambers pressure.

U.S. Pat. No. 3,472,445 shows in FIGS. I to VI a rotary machine having single lobe rotors. A disadvantage with single lobe rotors is that during a portion of each rotor rotation there is a dwell period during which no displacement occurs. The dwell period can be seen in FIGS. IV and V of U.S. Pat. No. 3,472,445, lasts about 90 degrees; and during the dwell period, no gas is drawn into the inlet port 16 and the flow through same is completely stopped once per rotation. Thus (with single lobe rotors) the flow of gas into the inlet port has a start-stop-start-stop action which would have a detrimental effect on efficiency and noise.

U.S. Pat. No. 3,472,445 shows in FIG. XX a machine wherein each rotor has two lobes. However, the two rotors are identical and there is no teaching of the need, construction, and advantages of making the double lobe rotors dissimilar as taught in the present invention.

OBJECTS AND ADVANTAGES OF THIS INVENTION

1. The first object is to reduce to a negligible amount a certain precompression and subsequent throttling loss when the machine is operated as a compressor; or an expansion loss when the machine is operated as an expansion engine. This objective is secured by making the lobes on the port controlling first rotor small in angle.

2. A second object of this invention is to provide large angle lobes on the co-acting second rotor as this leads to better efficiency as will subsequently be explained under reasons a, b, and c. Thus, this invention teaches the concept of using non-identical rotors with small angle lobes 24 on the port controlling first rotor and larger angle lobes 28 on the co-acting second rotor.

3. An advantage is that a separate external conduit (with the attendent flow losses therein) is not required in order to secure the first objective.

4. Another object of this invention is to arrive at and form a decision as to the optimum of lobes on each rotor for this specific type of rotary machine; i.e. should there be one, two, three, or four lobes per rotor? Should one rotor contain more lobes than the other rotor? It will be shown that the optimum combination is to employ exactly two lobes on each rotor.

5. An advantage of this invention is that the cubic displacement per rotation of the rotors (for a given rotor diameter and width) has been substantially increased. This advantage is obtained by employing rotors with double lobes (instead of single lobes) as will be described.

6. A sixth objective is to reduce the percent leakage and also reduce the overall size and weight of the machine. These advantages are made possible because of the increased displacement per rotation as described in the previous paragraph five; and as will be described in more detail.

7. An advantage (not new) is that the rotors and higher pressure ports 36 are profiled in such a way that the clearance volume is zero (or near zero) so that when operating as a compressor, the machine delivers (through the ports 36) all the full pressure gas it compresses and none is throttled (wasted) back to inlet pressure except a small portion due to leakage and running cleanance. This feature is not new with this invention as it was described in U.S. Pat. No. 3,472,445.

The dump pockets 63 in FIG. 7 constitute a non-delivered volume but the gas therein is dumped at a low pressure (and not full discharge pressure) as will be described; therefore, the dump pockets 63 are not counted when determining clearance volume.

8. Another advantage (not new) is that there are no geometric leak paths such as are associated with some screw type machines.

9. Another advantage (not new) is that the rotors are simpler to construct compared to screw type machines.

10. Another advantage of this invention (as a compressor) is that with two lobes per rotor (instead of a single lobe) the said dwell period has been eliminated and thus the flow of gas or air into the port 34 is more steady in character so that the start-stop-start-stop action of single lobe rotors has been eliminated. This will aid efficiency, reduce noise, and permit smoother running in general.

11. An unexpected feature of this invention is that the dump pockets 63 (shown in FIG. 7) have a very low energy loss. This loss (due to dumping at low pressure) is calculated to be less than one tenth of one percent of the total adiabatic work of the machine as will be described for FIG. 7.

12. An advantage (not new) is that no oil is required directly on the rotors, and thus in a compressor, the output air can be oil free.

13. Another object of this invention is to provide a rotary machine having an operating pressure ratio as high as 3 to 1 per stage as will be described in the description of FIG. 7.

Further objects of this invention, as well as the novel features thereof, will become more apparent by reference to the following description taken in conjunction with the accompanying figures.

GENERAL METHOD OF OPERATION—FIG. 4

Figure 4:
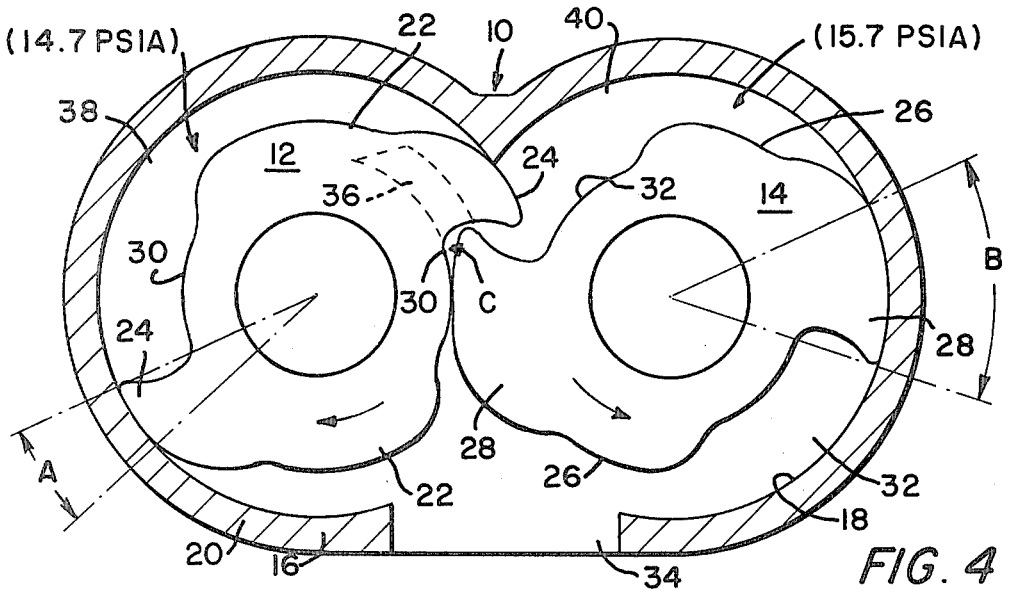
FIG. 4 illustrates an embodiment of this invention in which significant precompression is virtually eliminated, the same also being an elevational line drawing of the rotors but the casing in section.

Operation of the novel machine 10 as a compressor will be first explained by referring to FIG. 4. A first rotor 12 and a second rotor 14 are rotatably mounted in the intersecting bores 16 and 18 in the casing structure or housing 20. The first rotor 12 has a hub 22 and two teeth or lobes 24 projecting radially outward from the hub to the outer radius of the rotor. The second rotor 14 has a hub 26 and two larger angle teeth or lobes 28 projecting radially outward from the hub to the outer radius of the rotor. Each hub has grooves 30 and 32 located adjacent its respective lobes 24 and 28. Timing gears mounted on the rotor shafts (not shown) constrain the two rotors to rotate in timed interengaging relation. A source of power is applied to a rotor shaft so as to rotate the rotors in the direction shown (when operating as a compressor). The working fluid or gas to be compressed enters an inlet port 34, is compressed internally within the machine, and is then delivered through two ports 36, (only one is shown, partially in dotted lines) which are located in opposite end walls of the housing 20. The ports 36 are alternately covered and uncovered by the first rotor 12 so as to control the flow of the working fluid through the ports. The compressed gas is then conducted from the two ports 36 to a common outlet (not shown).

When operating as an expansion engine, rotation is reversed, high pressure motive gas is supplied to the end ports 36, and the lower pressure exhaust gas leaves at port 34.

The ports 36 (in the housing end walls) are referred to as the higher pressure ports and the port 34 is referred to as the lower pressure port since this designation is applicable for operation of the machine 10 either as a compressor or as an expansion engine.

Most of the discussion herein pertains to operation of the machine 10 as a compressor, only for purpose of simplicity; however, those improvements described for a compression cycle would also benefit the operation of the machine 10 as an expansion engine.

FIG. 4 shows the small chamber C which is near the end of delivery and is being closed out. To obtain zero (or near zero) clearance volume, all the gas in chamber C is to be delivered through the ports 36 so as to avoid wasting any compressed gas. To obtain this feature, the following requirements are needed: (a) the trailing edge of port 36 should be a circular arc projected from or by the outer radius of the second rotor, (b) the convex face of lobe 28 should be tangent to the outer radius of the same lobe, (c) the circumferential width (at the pitch circle) of said convex face should be at least as large as the radial height of said convex face from the pitch circle outward, and (d) the tip of lobe 28 should sweep in sealing proximity across the concave face of lobe 24. Zero clearance volume and the construction therefore was described in detail in U.S. Pat. No. 3,472,445.

Figure 7:
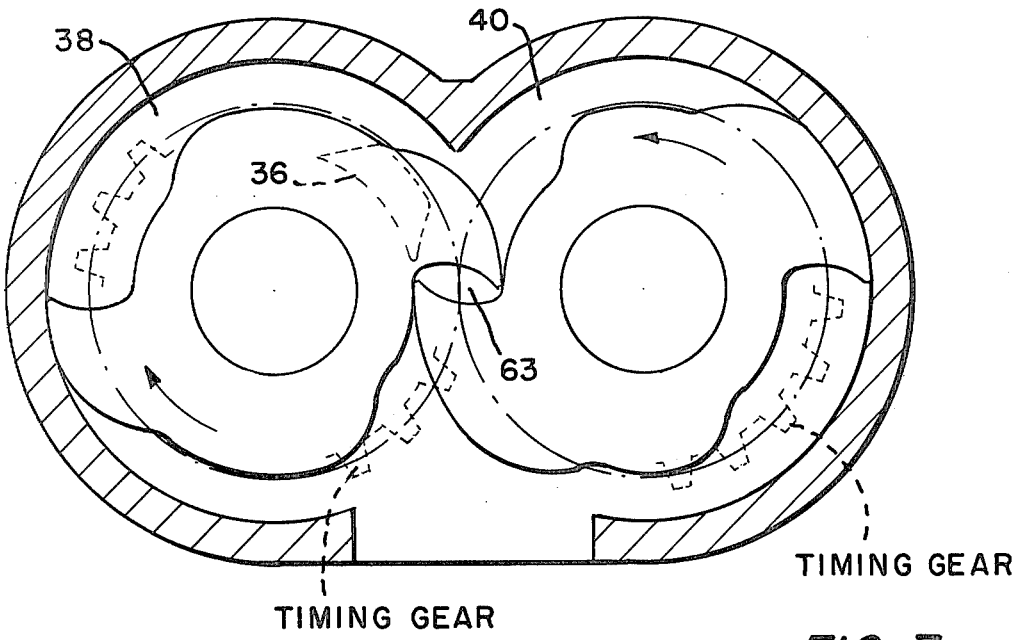
FIG. 7 is the same as FIG. 4 except the rotors have been rotated to show the dump pockets 63.

FIG. 7 shows the rotor positions where the ports 36 are still covered by the first rotor. The rotors will rotate about sixty degrees more from the FIG. 7 position before the ports 36 start to be uncovered and during this period, internal compression takes place in the chambers 38 and 40. The rotor and port profiles shown in FIGS. 4 and 7 are calculated and drawn approximately to scale for a 3 to 1 pressure ratio. Thus in a two stage air compressor (with atmospheric inlet), the discharge pressure of the second stage would be $3\times3\times14.7=132.3$ PSIA $=117$ PSIG. The ports 36 start to be uncovered approximately 25 degrees ahead of the theoretical pressure ratio of 3 location. Thus during said 25 degrees, there is a slight amount of backflow of air from the discharge line back into chambers 38 and 40. Such backflow represents a small energy loss which is more than compensated for in increased port area so that the net loss due to throttling through the ports 36 is less. Said early port opening might be compared (in a very general way) to advancing the spark in an internal combustion engine.

This invention teaches the use of two lobes per rotor and no more. If (for instance) the machine instead had three or four lobes per rotor, then each lobe would have less angular distance to travel during the compression phase; and thus the discharge ports 36 would have to be much smaller in angle to secure the same built-in pressure ratio—a serious disadvantage. In fact, if there were say four lobes per rotor, the ports 36 would be reduced to almost nothing and the 3 to 1 internal built-in pressure ratio would still not be achieved.

DISCUSSION OF LOSS PROBLEM ENCOUNTERED WITH PRIOR ART—FIGS. 1 TO 3

Figure 1:
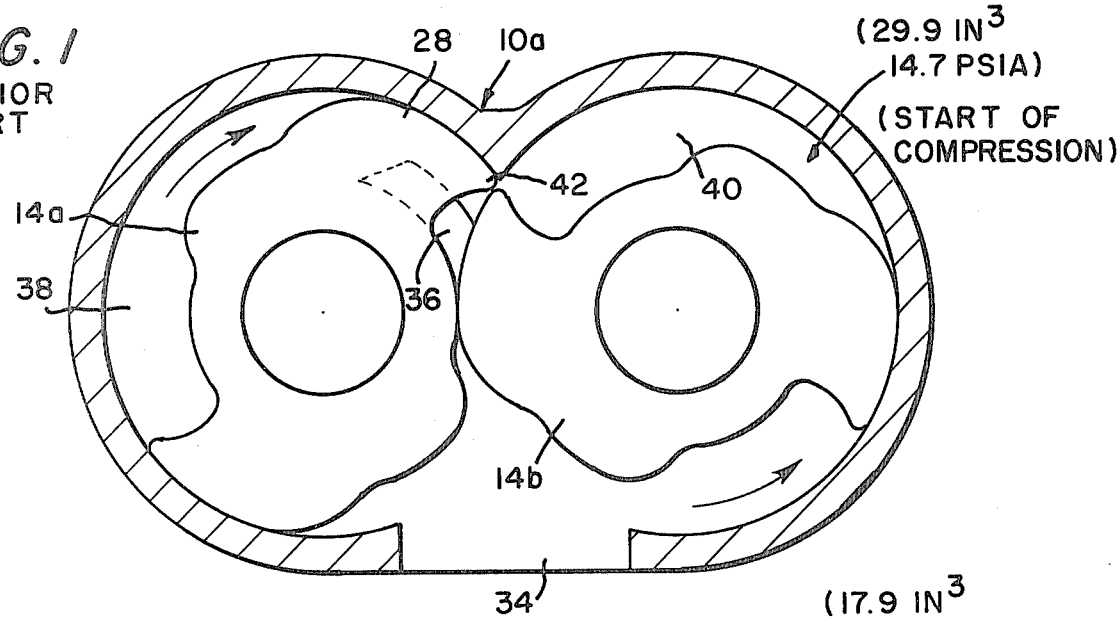
FIG. 1 PRIOR ART
FIGS. 1, 2, and 3 are line drawings illustrative of prior art rotors and casings (with the rotors in elevation and the casings in section) in successive, compressor-function rotative positions. These figures depict the unwarranted precompression and subsequent internal throttling loss encountered with such prior art construction.
Figure 2:
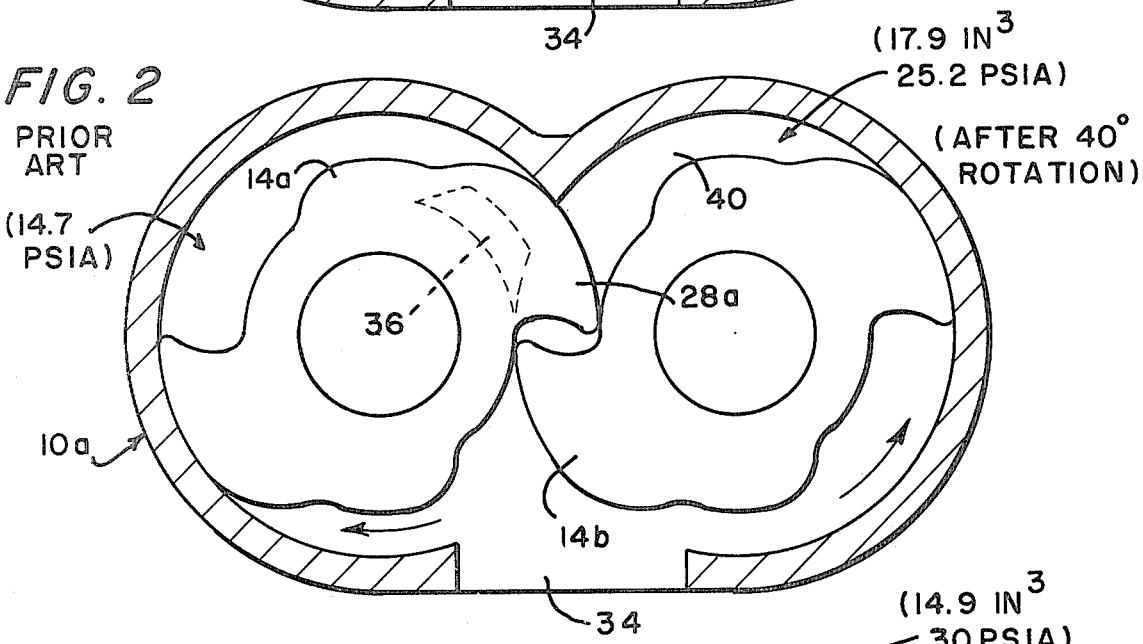
FIG. 2 PRIOR ART

In FIG. 1, both rotors are identical to the second rotor 14 (FIG. 4), and so are designated **14*a* and 14*b*. In such a prior art machine 10*a*, and when operating as a compressor, the pressure in chambers 38 and 40 is still at or near inlet pressure. The leading tip 42 of lobe 28*a* is just beginning to enter chamber 40 and this is the start of "precompression" (an undesirable effect). FIG. 2 shows the rotor positions after forty degrees of rotation from their FIG. 1 positions. As can be seen in FIG. 2, the lobe 28*a* has projected into chamber 40, reducing the chamber volume from 29.9 cubic inches to 17.9 cubic inches, and thus causing a "precompression" in chamber 40. With the proportions as drawn, neglecting leakage, and assuming atmospheric inlet pressures at port 34 and chamber 38, the pressure in chamber 40 (at the FIG. 2** rotor positions) is calculated to be 25.2 PSIA (or 10.5 PSIG above atmospheric).

Figure 3:
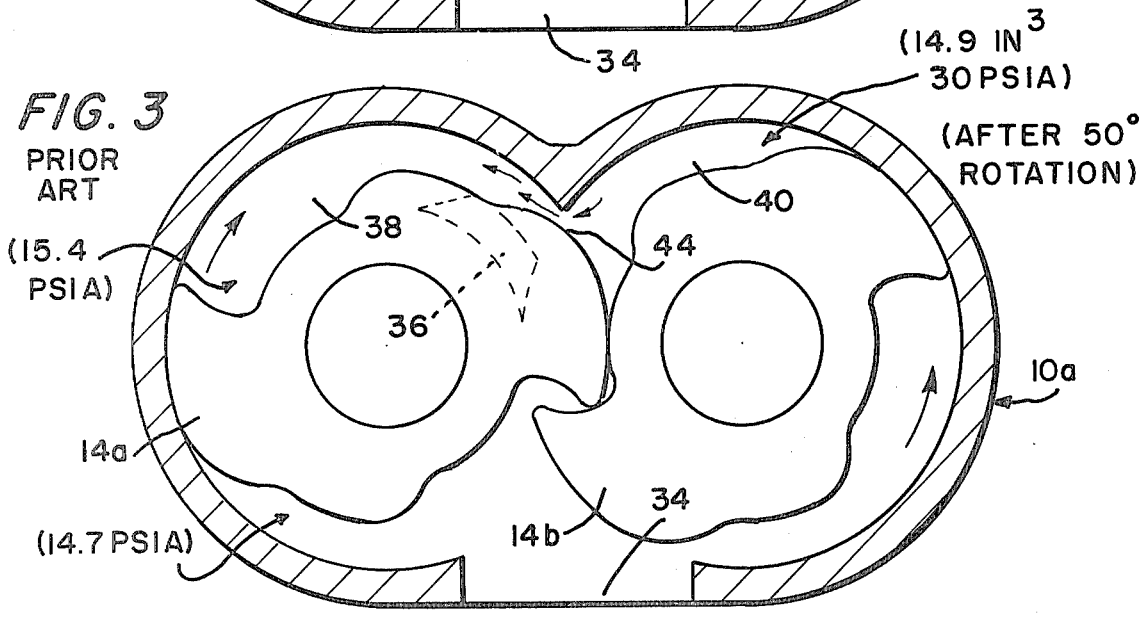
FIG. 3 PRIOR ART

FIG. 3 illustrates the rotor positions after fifty degrees of rotation from the FIG. 1 positions. A throttling loss occurs at 44 as the "precompressed air" in chamber 40 throttles into chamber 38. It is an object of this invention to reduce such loss in a simple manner, as explained in the following text.

DETAILED DESCRIPTION OF THIS INVENTION—FIG. 4

Reverting to FIG. 4, the port controlling rotor 12 is referred to as the first rotor; and the coacting rotor 14 is referred to as the second rotor. The first rotor 12 is provided with smaller angle lobes 24 which have an angle of arc "A" of about fifteen degrees as shown. The second rotor 14 has larger lobes 28 which have an angle of arc "B" of about thirty to forty degrees as shown.

With such an arrangement, the precompression effect is much less. With the proportions as drawn, neglecting leakage, and assuming atmospheric inlet pressure at port 34 and chamber 38 the pressure in chamber 40 (at the FIG. 4 rotor positions, and with the novel rotors) is calculated to be 15.7 PSIA or 1 PSIG above atmospheric. This 1 PSIG is compared with 10.5 PSIG in FIG. 2 of the prior art. Thus the effect of precompression (and subsequent throttling of same) is greatly reduced.

From the standpoint of compression efficiency, the second rotor 14 should have lobes 28 with a larger included angle than that of the first rotor 12. There are three separate reasons for this (a, b, and c as follows): (a) In a rotary compressor, the uncovered area of the discharge ports 36 becomes less and less as the lobes approach the end of each delivery phase of the rotor cycle (see the rotor positions shown in FIG. 1). If the second rotor 14 is provided with a lobe 28 having a thirty degree (or larger) angle of arc B (FIG. 4), then it can finish its portion of the delivery phase of the cycle (as shown in FIG. 1) prior to the completion of the first rotor lobe delivery. Result: there is less pressure drop through the discharge ports 36 during the last critical phase of each delivery portion of the cycle. (b) If the second rotor 14 is provided with lobes 28 with the larger thirty degree angle of arc B, then the first rotor 12 (the port controlling rotor) can be provided with thirty degree grooves 30. Result: the discharge ports 36 are uncovered longer by the larger thirty degree grooves 30 in the port controlling first rotor 12. Thus, there is less pressure drop through the discharge ports 36 than if all the grooves 30, 32 and all the lobes 24, 28 were fifteen degrees of arc or less. (c) A large angle of arc B has a longer leak path for the leakage of air past the lobes 28. Test data show that a long leak path has more flow resistance than a short leak path or a sharp edge. Result: less leakage.

DETAILED DESCRIPTION OF THIS INVENTION—FIG. 5

The cross-section view of an alternative embodiment **10*b* of the invention (FIG. 5) is taken perpendicular to the axis of the rotors 12*a* and 14*c* and midway along the axial width of the rotors. The rotors 12*a* and 14*c* shown here are similar to those shown in FIG. 4 except the first rotor 12*a* is provided with a flat disk 50 mounted on each axial end and rotatable therewith. The purpose of the flat disks is to permit the outer edge 52 of the higher pressure ports 36*a* to be extended to near the outer radius of the rotor 12*a*. Thus the port area is approximately doubled so as to permit longer rotors and/or higher RPM. Each end of the second rotor 14*c* is milled or profiled, along dotted lines 54, so as to interengage with the periphery of a respective disk 50**.

Figure 5:
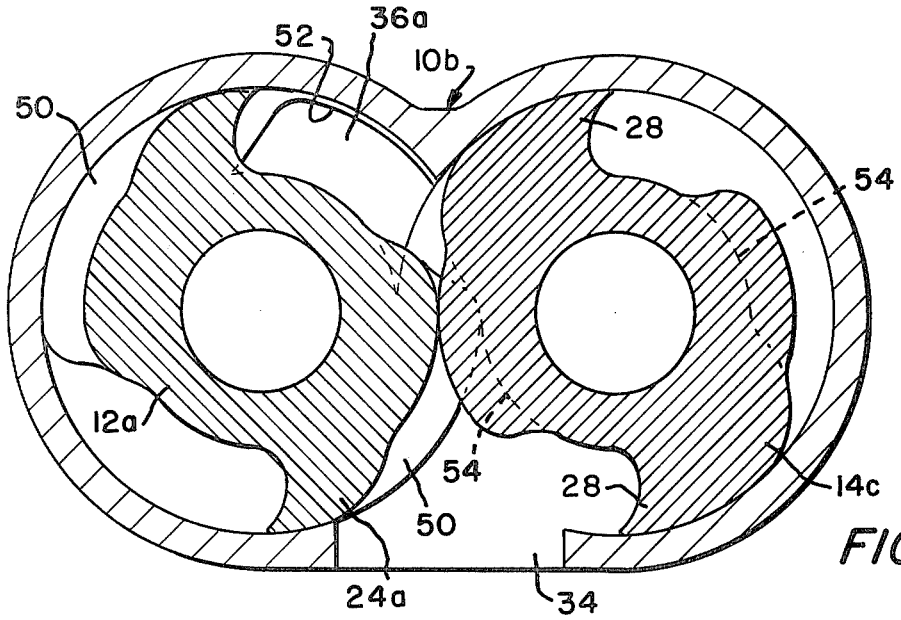
FIG. 5 illustrates an alternative embodiment of this invention, in a cross-sectional elevational view.

The axially intermediate, cross-section profiles of the FIG. 5 rotors **12*a* and 14*c* are identical with the cross-section profiles of the FIG. 4 rotors 12 and 14. More specifically, the lobes 24*a* on the first rotor 12*a* are small in angle, whereas the lobes 28 on the second rotor 14*c*** are larger in angle.

DETAILED DESCRIPTION OF THIS INVENTION—FIG. 6

Figure 6:
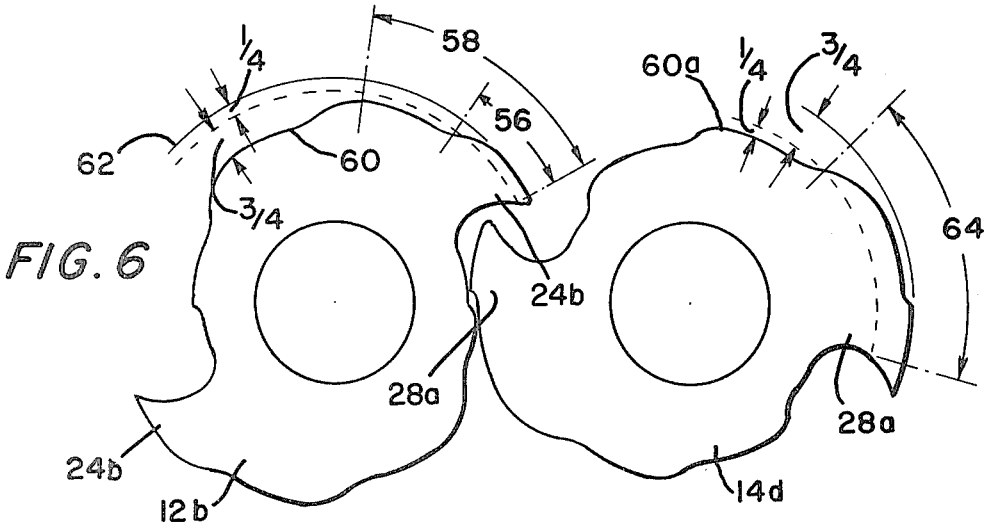
FIG. 6 illustrates a further alternative embodiment of the invention.

FIG. 6 shows how the rotors of the novel machine **10, 10*b*, etc., may be modified, in a general way, within the scope and teaching of the invention. As in the other figures, the port controlling first rotor 12*b* is shown on the left and the coacting second rotor 14*d*** is on the right.

The first rotor tooth **24*b* is proportioned with a small included angle 56 (about twenty-six degrees as drawn) for the same reason given for FIG. 4: to prevent precompression, and subsequent throttling of the gas. The tooth is larger in angle at 58 but this has little or no effect on the tooth's ability to prevent precompression. The radial location for measuring the angle 56 is arbitrarily taken at $\frac{3}{4}$ of the way from the pitch circle 60 to the outer radius 62** of the rotor as shown.

The pitch circles of a pair of rotors is defined as follows: If the two rotors rotate at the same rotative speed, then the pitch circles of the two rotors are of equal diameter and each pitch circle has a diameter equal to the distance between the axis of rotation of the two rotors. Each pitch circle has its center on the axis of rotation of its respective rotor.

The second rotor tooth **28*a* is proportioned with a large angle 64 (fifty to sixty degrees) for the same reasons given for the large angle "B" in FIG. 4. The radial location for measuring the angle 64 is arbitrarily taken at one fourth of the way from the pitch circle 60*a* to the outer radius of the rotor 14*d* as shown in FIG. 6. This invention therefore teaches the concept of making angle 56 substantially less than angle 64 (for the reasons stated in connection with FIG. 4**).

DUMP POCKETS—FIG. 7

FIG. 7 shows the FIG. 4 rotors at the formation of dump pockets 63. The gas contained in the pockets 63 is only slightly pressurized and in about the next five degrees of rotor rotation this low pressure gas is dumped back to inlet pressure. In the first stage of an air compressor having a pressure ratio of 3 to 1 per stage, the calculated power loss due to dump pockets 63 is less than one tenth of one percent of the adiabatic work of compression. The reasons for such an unexpectedly low power loss due to dump pockets are: (a) The calculated pressure at dumping is only about 3 PSIG, (b) The volume of the dump pockets is 7% of the total displacement, and (c) the power or energy loss is that due to internal compression only as there is no loss due to delivery work since the 3 PSIG gas is merely dumped back to inlet pressure and not delivered to a discharge line.

To calculate the energy loss due to dump pockets, proceed as follows: The work of internal compression only (no delivery) is $(P_2V_2-P_1V_1)/(1\text{-}K)$ from any text on thermodynamics. Use absolute pressures. Deduct the area below the atmospheric line as this is not a work item.

THE OPTIMUM OF LOBES FOR EACH ROTOR IS TWO—FOR THE FOLLOWING FOUR REASONS

1. Double lobe rotors have a net cubic displacement per rotation which is 18% more than for single lobe rotors. This is because single lobe rotors have a dwell period during which no displacement occurs as can be seen in FIGS. IV and V of U.S. Pat. No. 3,472,445. More displacement per rotation is a very desirable feature since it increases capacity and reduces percent leakage; and therefore double lobe rotors are (for this reason) preferable over single lobe rotors.

2. There is no point, however, in going to three lobes or four lobes per rotor as this would gain nothing further in displacement since said dwell period is eliminated in going from one lobe per rotor to two lobes per rotor. Three or four lobe rotors would cut down on the angle (and thus area) of the higher pressure ports for a given built-in pressure ratio (a serious disadvantage). Further, three or four lobe rotors would be more expensive to make and more critical to time with timing gears.

3. If the rotors have two lobes per rotor (instead of one), then the dwell period is eliminated and the inlet flow (as a compressor) is more steady so as to avoid that start-stop-start-stop flow action.

4. Double lobe rotors have dump pockets (FIG. 7) but single lobe rotors do not have dump pockets; and thus this led me to believe for several years that single lobe rotors were superior to double lobe rotors. Later on, however, I calculated that the power loss due to dump pockets is less than one tenth of one percent of the adiabatic work of compression—a negligible amount as previously described.

Even after deducting for the dump pockets 63, the displacement of double lobe rotors is still 18% greater than single lobe rotors.

While I have described my invention in connection with specific embodiments thereof, it is to be understood that this is down only by way of example, and not as a limitation to the scope of my invention as set forth in the objects thereof and in the appended claims.

I claim:

1. A rotary, positive displacement machine, with interengaging rotors having different-sized lobes, adapted to handle a working fluid, comprising:

a casing structure having a pair of intersecting bores;

a first rotor mounted for rotation in one of said bores;

a second rotor mounted for rotation in the other of said bores;

timing gear means constraining said two rotors to rotate in timed, interengaging relation;

said casing structure having a high pressure port for the flow therethrough of working fluid at high pressure;

said casing structure further having a low pressure port for the flow of the working fluid therethrough at lower pressure;

said high pressure port being located in an end wall of said one bore;

said first rotor having means for alternately covering and uncovering said high pressure port, to control flow of working fluid through said high pressure port;

said first rotor further having two lobes; and said second rotor also having two lobes; wherein said lobes on said second rotor have substantially larger included angles than said lobes on said first rotor to minimize precompression and concomitant throttling loss in the machine when operated as a compressor, and to minimize expansion loss when operating the machine as an expander;

said lobes on said first and second rotors have peripheral, circumferentially-extended surfaces which define close-clearance interfaces with inner surfaces of their respective bores;

said peripheral surfaces of said lobes of said second rotor each occupying an angle of approximately twice that of said peripheral surfaces of said lobes of said first rotor;

said peripheral surfaces of said lobes of said second rotor each comprising means defining a substantially-extended, circumferential leakage path with said inner surface of said other bore;

said port covering and uncovering means comprises means for wholly covering and uncovering said high pressure port; and said high pressure port is covered and uncovered only by said first rotor.

2. A rotary, positive displacement machine, according to claim 1, wherein:

said angle of said peripheral surfaces of said first rotor lobes is a maximum of 35 degrees of arc, each; and said angle of said peripheral surfaces of said second rotor lobes is a minimum of 50 degrees of arc, each.

3. A rotary, positive displacement maching, according to claim 1, wherein:

said angle of said peripheral surfaces of said first rotor lobes is not less than approximately five degrees of arc, and not more than approximately nineteen degrees of arc; and said angle of said peripheral surfaces of said second rotor lobes is not less than approximately twenty-one degrees of arc, and not more than approximately fifty degrees of arc.

4. A rotary, positive displacement machine, according to claim 1, wherein:

each of said rotors further having a hub;

each of said lobes project radially outward, from a respective hub to said peripheral surfaces thereof;

each hub having two grooves therein;

each groove being located adjacent a respective lobe;

said hubs being profiled so as to rotate in sealing relation to each other during a portion of each rotation; and wherein said grooves in said hub of said first rotor each occupy an angle of approximately twice that of said peripheral surfaces of said lobes of said first rotor.

5. A rotary, positive displacement machine, according to claim 4, wherein:

said high pressure port occupies an angle approximately corresponding to the angle occupied by each of said peripheral surfaces of said lobes of said second rotor.

6. A rotary, positive displacement machine, according to claim 4, wherein:

said high pressure port occupies an angle substantially corresponding to the angle occupied by each of said grooves in said hub of said first rotor.

7. A rotary positive displacement machine, with interengaging rotors having different sized lobes, adapted to handle a working fluid comprising:

a casing structure having a pair of intersecting bores;

a first rotor mounted for rotation in one of said bores;

a second rotor mounted for rotation in the other of said bores;

timing gear means constraining said two rotors to rotate in timed, interengaging relation at equal R.P.M. and in opposite directions of rotation, said casing structure having a higher pressure port for the flow therethrough of the working fluid at higher pressure;

said casing structure also having a lower pressure port for the flow of the working fluid therethrough at lower pressure;

said higher pressure port being located in an end wall of the bore containing said first rotor;

said first rotor being adapted to alternatively cover and uncover said higher pressure port so as to control the flow of the working fluid through said higher pressure port; each rotor having a hub mounted on a shaft;

each rotor having two main lobes attached to a respective hub;

each said lobe projecting radially outward from its respective hub to the other radius of the rotor;

each hub having two grooves therein;

each said groove being located angularly adjacent a respective lobe;

said hubs being profiled so as to rotate in sealing relation to each other during a portion of each rotation;

each lobe being adapted to interengage with a respective groove in the opposite rotor hub as the motors rotate;

said rotors being adapted to displace the working fluid inside said bores as they interengage and rotate inside said bores; and wherein the improvement comprises in combination;

said machine having a built-in compression ratio (when operating as a compressor) such that the working fluid is compressed internally within the machine before being discharged through said higher pressure port, the amount of said built-in compression ratio being determined by the angular extent of said higher pressure port and the number of lobes per rotor;

said machine having a built-in expansion ratio (when operating as an expansion engine) such that the working fluid expands internally within the machine before being discharged through said lower pressure port, the amount of said built-in expansion ratio being determined by the angular extent of said higher pressure port and the number of lobes per rotor;

the number of said lobes contained by each rotor being exactly two so as to secure: (a) maximum flow area for said higher pressure port for a given built-in compression ratio (when operating as a compressor), and (b) maximum flow area for said higher pressure port for a given built-in expansion ratio (when operating as an expansion engine); further the number of said lobes contained by each rotor being two so as to secure more displacement per rotation and a smoother flow of the working fluid through said lower pressure port;

said two rotors being adapted to rotate at equal R.P.M. in opposite directions of rotation;

the diameter of the pitch circle of each rotor being equal to the distance between the axes of rotation of the two rotors;

each said pitch circle having its center at the axis of its respective rotor;

each of said lobes having profiles which are concave on one face of the lobe and partly convex on the other face of the lobe;

said convex faces lying outside the pitch circle of their respective rotor;

said rotors comprising means defining two low pressure dump pockets per rotor rotation;

each said dump pocket being bounded by said concave faces of two lobes;

each of said dump pockets dumping slightly pressurized working fluid back to lower inlet pressure when operating as a compressor machine;

the included angle occupied by said lobes in the first rotor being substantially smaller than the included angle occupied by said lobes on the second rotor;

a purpose of making the lobes on the first rotor smaller in angle being to reduce a precompression loss (when operating as a compressor) and to reduce an expansion loss (when operating as an expander);

a purpose of making the lobes on the second rotor larger in angle being to reduce a throttling loss of the working fluid as it passes through said higher pressure port near the end of each delivery phase (when operating as a compression); and a purpose of making the lobes on the second rotor large in angle being to reduce a throttling loss of the working fluid as it passes through said higher pressure port near the start of admission (when operating as an expansion engine).

8. A rotary positive displacement machine according to claim 7 wherein:

the angle of the radially outward peripheral surfaces of each first rotor lobe is not less than five degrees of arc, and not more than nineteen degrees of arc; and said angle of the radially outward peripheral surfaces of said second rotor lobes is not less than twenty-one degrees of arc, and not more than fifty degrees of arc.

9. A rotary positive displacement machine according to claim 7 wherein:

the included angle of the radially outward peripheral surface of said first rotor lobes is a maximum of 20 degrees of arc each; and wherein the included angle of the radially outward peripheral surface of said second rotor lobes is a minimum of 25 degrees of arc, each.

10. A rotary positive displacement machine, according to claim 7 wherein:

said structure and said rotors comprise means defining a cyclically formed precompression chamber within the machine;

said precompression chamber being bounded by said second rotor and the bore containing said second rotor;

the said lobes on the first rotor each having a pointed front tip (when operating as a compressor);

each said pointed front tip being formed by the radially outward periphery of the rotor lobe and a said concave face of the lobe; and wherein each said pointed front tip momentarily projects into said precompression chamber so as to cause a precompression of the working fluid;

said precompression being an undesirable effect as subsequent throttling results therefrom; and wherein the amount of said precompression is low due to the low relative volume of said pointed front tip.

11. A rotary positive displacement machine, according to claim 7, wherein:

each said lobe is in sealing proximity with its respective casing bore throughout a finite angle (as opposed to a single edge); and wherein the said finite angle occupied by said first rotor lobes is substantially smaller than the finite angle occupied by said second rotor lobes.

12. A rotary positive displacement machine, according to claim 7, wherein:

the said included angle of the first rotor lobes is measured at a radical location which is three quarters of the radial distance from the rotor pitch circle to the outer radius of the rotor; and wherein the said included angle of the second rotor lobes is measure at a radial location which is one fourth of the radial distance from the rotor pitch circle to the outer radius of the rotor.

13. A rotary positive displacement machine, according to claim 7, wherein:

said grooves in said hub of said first rotor each occupy an angle of approximately twice that of the angle occupied by the outer radius of said lobes of said first rotor.

14. A rotary positive displacement machine, according to claim 13 wherein:

said higher pressure port occupies an angle approximately equal to the angle occupied by each of the outer radial peripheral surfaces of said lobes of said second rotor.

15. A rotary positive displacement machine according to claim 13 wherein:

said higher pressure port occupies an angle substantially equal to the angle occupied by each of said grooves in the hub of the first rotor.

* * * * *

UNITED STATES PATENT AND TRADEMARK OFFICE

CERTIFICATE OF CORRECTION

PATENT NO. : 4,224,016

DATED : September 23, 1980

INVENTOR(S) : Arthur E. Brown

It is certified that error appears in the above—identified patent and that said Letters Patent is hereby corrected as shown below:

In column 2, line 22, "cleanance" should be --clearance--;

In column 9, line 4, "other" should be --outer--;

In column 9, line 12, "motors" should be --rotors--;

In column 9, line 17, the semicolon (;) should be a colon (:);

In column 10, line 66, "radical" should be --radial--;

In column 11, line 2, "measure" should be --measured--.

Signed and Sealed this

*Eleventh* Day of *May 1982*

[SEAL]

*Attest:*

GERALD J. MOSSINGHOFF

*Attesting Officer*

*Commissioner of Patents and Trademarks*